United States Patent [19]

Learn et al.

[11] 4,213,121

[45] Jul. 15, 1980

[54] CHIME TONE AUDIO SYSTEM UTILIZING A PIEZOELECTRIC TRANSDUCER

[75] Inventors: Richard L. Learn, Indianapolis; Louis P. Sweany, Carmel, both of Ind.

[73] Assignee: Emhart Industries, Inc., Indianapolis, Ind.

[21] Appl. No.: 913,732

[22] Filed: Jun. 8, 1978

[51] Int. Cl.[2] ..... G08B 3/00

[52] U.S. Cl. ..... 340/384 E; 340/384 R

[58] Field of Search ..... 340/384 R, 384 E

[56] References Cited

U.S. PATENT DOCUMENTS

| | | | |
|---|---|---|---|
| 3,569,963 | 3/1971 | Mallory | 340/384 R |
| 3,573,630 | 4/1971 | Baer | 340/384 X |
| 4,001,816 | 1/1977 | Yamada | 340/384 E |
| 4,104,628 | 8/1978 | Sweany | 340/384 E |

*Primary Examiner*—Harold I. Pitts

*Attorney, Agent, or Firm*—Hoffmann & Meyer

[57] ABSTRACT

An audible signalling system utilizes a piezoelectric transducer to produce a chime tone audible signal. The system includes audible signalling circuitry, circuitry for driving the audible signalling circuitry to provide a pulsed audible signal, and circuitry for exponentially decaying the pulsed audible signal to produce a chime tone audible signal.

15 Claims, 4 Drawing Figures

CHIME TONE AUDIO SYSTEM UTILIZING A PIEZOELECTRIC TRANSDUCER

BACKGROUND OF THE INVENTION

1. Field of the Invention

The present invention relates generally to audible signalling systems which utilize a piezoelectric component to provide an audible signal and which include circuitry for sufficiently driving the piezoelectric component to produce the audible signal. More particularly, the present invention relates to circuit means electrically coupled to the circuitry for driving the piezoelectric component for producing a sharp attack audible sound followed by a decay in sound level which is a characteristic of a chime tone audible signal.

Generally speaking, the audio system of the present invention includes an audible signalling circuit which includes a piezoelectric transducer, circuitry for driving the audible signalling circuit whereby a pulsed audible signal is provided by the piezoelectric transducer, and circuit means electrically interposed between the audible signalling circuit and the circuitry for driving the signalling circuit for exponentially decaying the pulsed audible signal whereby a chime tone audible signal is produced.

2. Description of the Prior Art

One of the major problems associated with previous audible signalling systems and/or devices is their inherently unpleasant sound. For example, in automobile alarm systems or audio indicators and in paging systems the audible signal produced is typically constant and at a peak sound level until discontinued. While in some applications an audible signal which continuously produces a peak sound level is desirable, it is many times desirable or required that the audio output be less irritating and more pleasing to the listener. A common less irritating audible signal is a chime tone audible signal where a periodic instantaneous peak sound level is produced which gradually dissipates over a period of time before a subsequent peak sound level is again produced.

Various audible signalling systems exist in the prior art for producing a chime tone audible signal most of which require complex circuitry to operate and/or are too large to be utilized in many applications such as the previously discussed automobile audio indicators and paging systems. Furthermore, many audible signalling systems can exhibit a nonlinear relationship between audio output and electrical input and also exhibit a large frequency change over a range of electrical inputs. By utilizing a piezoelectric transducer and appropriate associated circuitry, a chime tone audible signal may be produced which alleviates the problems enumerated hereinabove.

SUMMARY OF THE INVENTION

In accordance with the present invention in its broadest concept there is provided an audible signalling system which utilizes a piezoelectric component and circuit means electrically coupled to the piezoelectric component to produce a chime tone audible signal.

Accordingly, it is a feature of the present invention to provide an audible signalling system as described hereinabove wherein the circuit means includes pulsating means for providing a pulsed audible signal and means for exponentially decaying the pulsed audible signal to produce the chime tone audible signal.

It is another feature of the present invention to provide an audible signalling system as described hereinabove which is inexpensive, simple, and of relatively small size.

It is yet another feature of the present invention to provide an audible signalling system as described hereinabove which because of its instantaneous peak sound level and exponential decay of the audible output makes it well suited for use where a pleasing audible signal is required or desired.

It is a further feature to provide an audible signalling system as described hereinabove which exhibits a substantially linear relationship between the audio output and the voltage applied to the piezoelectric component to achieve the audio output and which further exhibits relatively small frequency changes over a range of applied voltages.

These and other features and advantages of the present invention will be apparent from the following detailed description of a preferred embodiment thereof, which description should be considered in conjunction with the accompanying drawings.

DESCRIPTION OF THE PREFERRED EMBODIMENT

Figure 1:
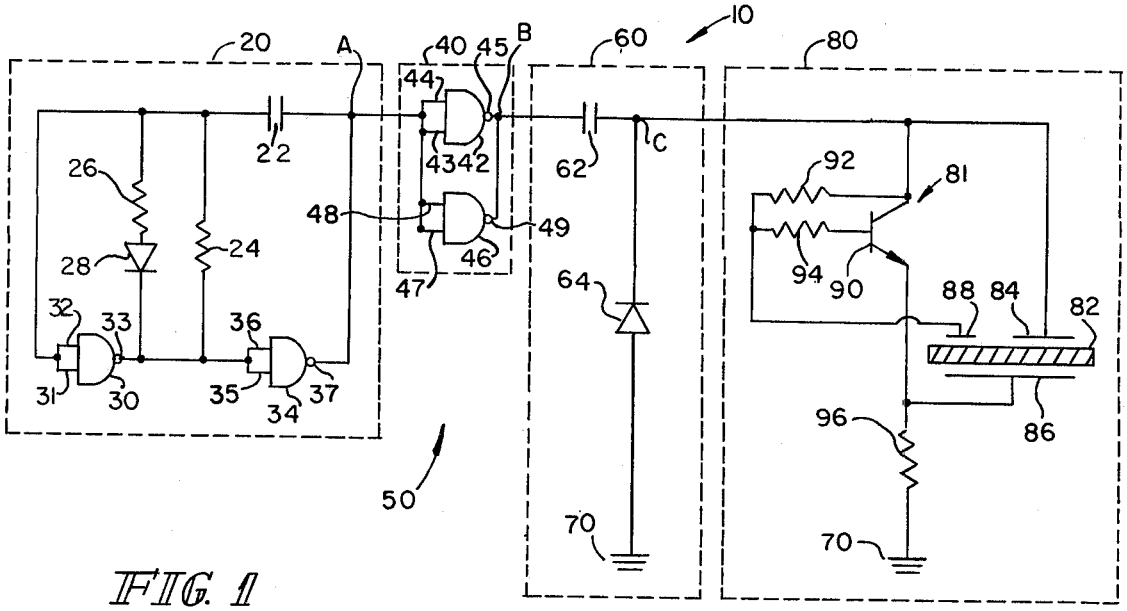
FIG. 1 is a schematic illustration of an embodiment of the audible signalling system of the present invention.

Referring to the above described figures and more particularly to FIG. 1, an audible signalling system 10 for producing an audible signal which is similar to a chime tone, includes a circuit 20 for pulsating an electrical signal provided by a power supply source (not shown) having a voltage magnitude V thereby providing a pulsed electrical signal at junction A representing the output of circuit 20, an inverting buffer circuit 40 electrically coupled to the pulsating circuit 20 and responsive to the pulsed electrical signal output of pulsating circuit 20 wherein the pulsed electrical signal is inverted and appears at junction B representing the output of circuit 40, a circuit 60 electrically coupled to the inverting buffer circuit 40 and responsive to the inverted pulsed signal output of inverting buffer circuit 20 for providing an exponentially decaying electrical signal at junction C representing the output of circuit 60, and an audible signalling circuit 80 which utilizes a piezoelectric transducer 82 to produce an audible signal in response to the pulsed electrical signal provided by pulsating circuit 20 and thereafter modified by inverting buffer circuit 40 and circuit 60 for exponentially decaying the pulsed electrical signal whereby a chime tone audible signal is produced. In combination, pulsating circuit 20 and inverting buffer circuit 40 comprise a circuit means 50 for driving audible signalling circuit 80 to provide an audible signal.

Figure 2:
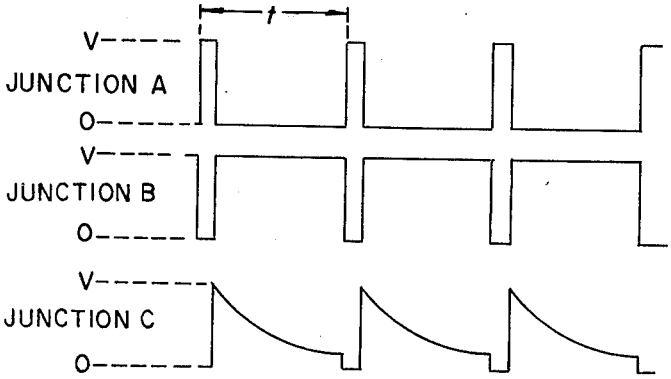
FIG. 2 is a representation of voltage waveforms taken from several locations in the audible signalling system illustrated in FIG. 1.

Circuit means 20 for providing a series of pulsed electrical signals in response to an electrical power supply source is an unbalanced multivibrator and includes two inverting logic gates which as illustrated are NAND gates 30 and 34 each having two inputs 31, 32 and 35, 36 respectively and an output 33 and 37 respectively. Inputs 31 and 32 of NAND gate 30 are commonly electrically coupled to a first side of a resistor 26, a first side of a resistor 24, and a first side of a capacitor 22. Inputs 35 and 36 of NAND gate 34 commonly electrically coupled to the output 33 of NAND gate 30, the cathode of a diode 28, and a second side of resistor 24. Diode 28 has its anode electrically coupled to a second side of resistor 26 and capacitor 22 has a second side electrically coupled to the output 37 of NAND gate 34 through a junction A representing the output of circuit means 20. As shown in FIG. 2, circuit means 20 causes the voltage V at junction A to rise and fall in essentially a square wave manner. In combination, capacitor 22, resistors 24 and 26, and diode 28 control the period t and pulse width of the pulsed voltage waveform provided at junction A. The outputs 33 and 37 of NAND gates 30 and 34 respectively serve as charging and discharging paths for capacitor 22 while the voltage at inputs 31 and 32 of NAND gate 30 determines the transition points for the output 33. When the output 33 of NAND gate 30 is high, the output of circuit means 20 at junction A is low and when the output 33 of NAND gate 30 is low, the output of circuit means 20 at junction A is high. Since diode 28 is electrically coupled in series with resistor 26 the resistance value of resistor 26 has an effect upon the period t and pulse width of the pulsed electrical signal only when the output 33 of NAND gate 30 is low and the output 37 of NAND gate 34 is high. Accordingly, the RC time constant of circuit means 20 is altered during each period t by the addition of resistor 26 to the RC network of resistor 24 and capacitor 22 thereby causing an unbalance in the time during which the output 37 of NAND gate 34 is high verses the time during which the output 37 is low. Preferably, the value of resistor 26 is chosen such that the pulsed voltage signal at junction A is high for at most 10% of the period t and low for at least 90% of the period t of the pulsed voltage signal (See FIG. 2). It should be noted that by directly applying the pulsed voltage signal at junction A to the audible signalling circuit 80 a pulsed audible signal would be produced which would be on or audible for at most 10% of the period t of the pulsed voltage signal and off or silent for at least 90% of the period t of the pulsed voltage signal.

Continuing to refer to FIG. 1 inverting buffer circuit 40 in response to the unbalanced pulsed electrical signal at junction A inverts the signal as shown in FIG. 2 whereby the pulsed voltage signal appearing at junction B is high for at least 90% of the period t of the signal and low for at most 10% of the period t. Furthermore, inverting buffer circuit 40 prevents capacitor 22 of circuit means 20 from interacting and thereby having an effect upon circuit means 60 for exponentially decaying the pulsed voltage signal appearing at junction B. Circuit means 40 also includes two inverting logic gates which as illustrated are NAND gates 42 and 46 each having inputs 43, 44 and 47, 48 respectively and an output 45 and 49 respectively. Inputs 43, 44 and 47, 48 of NAND gates 42 and 46 respectively are all commonly electrically coupled to the output (junction A) of pulsating circuit means 20 and the respective outputs 45 and 49 of gates 42 and 46 are commonly electrically coupled together at junction B representing the output of circuit means 40. Accordingly, the pulsed electrical signal appearing at junction A and modified by circuit means 40 as shown in FIG. 2 at junction B serves as the necessary drive signal for audible signalling circuit 80 to produce an audible signal. It should again be noted that without further modification of the pulsed electrical signal appearing at junction B a pulsed audible signal would be produced by audible signalling circuit 80 which would be on or audible for at least 90% of the period t of the pulsed electrical signal (junction B) and would be off or silent for at most 10% of the period t of the pulsed electrical signal.

Circuit means 60 for exponentially decaying the pulsed electrical signal appearing at junction B includes a capacitor 62 electrically interposed between circuit means 50 (junction B) and the audible signalling circuit 80 and a diode 64 having its cathode electrically coupled to capacitor 62 and its anode electrically coupled to ground potential 70 whereby diode 64 is in parallel to audible signalling circuit 80. When the pulsed electrical signal (i.e. voltage) at junction B is high (90% of period t) capacitor 62 charges through audible signalling circuit 80. Initially, (when the pulsed electrical signal at junction B is initially high) the magnitude of the voltage at junction C (See FIG. 2) is the same as the voltage of junction B. The sound level of the audible signal provided by audible signalling circuit 80 is related to the magnitude of the voltage at junction C and is at a maximum when the voltages at junctions B and C are equal and high. As time elapses, the charging of capacitor 62 results in an exponential increase in voltage across the capacitor 62. Simultaneously the voltage at junction C decreases exponentially as shown in FIG. 2 thereby causing the sound level of the audible signal provided by audible signalling circuit 80 to correspondingly decrease exponentially. When the pulsed electrical signal at junction B goes low (10% of period t) capacitor 62 is rapidly discharged through inverting buffer circuit 40 and diode 64. Diode 64 also serves to prevent the audible signalling circuit 80 from producing a new pulsed audible output signal during the discharge of capacitor 62. Understandably, component values for the resistors 24 and 26 and capacitor 22 of pulsating circuit means 20 and capacitor 62 of circuit means 60 should be chosen to give a repetition rate of pulses and a decay time whereby a new peak audible signal occurs at substantially the same moment that the exponential decay of the previous audible signal is completed. FIG. 2 shows the pulsed exponentially decaying signal which appears at junction C and which is further representative of the pulsed exponentially decaying audible signal produced by audible signalling circuit 80 in response thereto.

Again referring to FIG. 1 there is illustrated a conventional audible signalling circuit 80 which utilizes a piezoelectric transducer 82 to produce an audible output signal in response to an electrical input signal provided by circuit means 50. The circuit configuration of audible signalling circuit 80 is such that the piezoelectric transducer is driven to oscillate at substantially its resonant frequency. The circuit configuration 80 and piezoelectric transducer 82 combination are in essence similar to those previously disclosed by B. M. Potter in U.S. Pat. No. 3,277,465 and by Louis P. Sweany in U.S. Pat. No. 3,815,129. The audible signalling circuit 80 includes an amplifier circuit 81 and a piezoelectric transducer 82 which in combination produce an audible output signal in response to an electrical input signal. As illustrated, piezoelectric transducer 82 includes three electrodes 84, 86 and 88 each electrically coupled to the amplifier circuit 81 and one electrode 88 of which is used to provide a feedback to the amplifier circuit 81. A typical configuration for piezoelectric transducer 82 is more particularly disclosed by Louis P. Sweany in U.S. Pat. No. 3,815,129 and for purposes of disclosing piezoelectric transducer 82 in more detail U.S. Pat. No. 3,815,129 is hereby incorporated by reference. Amplifier circuit 81 includes an NPN transistor 90 having its collector electrically coupled to electrode 84 of transducer 82 and through resistors 92 and 94 to its base, its base further electrically coupled to feedback electrode 88 of transducer 82, and its emitter electrically coupled to electrode 86 and through a resistor 96 to ground potential 70. Electrodes 84 and 86 of transducer 82 function as the drive electrodes of the transducer 82. Resistors 92, 94, and 96 provide proper biasing for transistor 90. By selecting the proper polarities at electrodes 84 and 86 of the piezoelectric transducer 82 the feedback voltage at electrode 88 is caused to be in phase with the driving voltage whereby the transducer is caused to oscillate and oscillations are maintained at the resonant frequency of the transducer 82.

Figure 3:
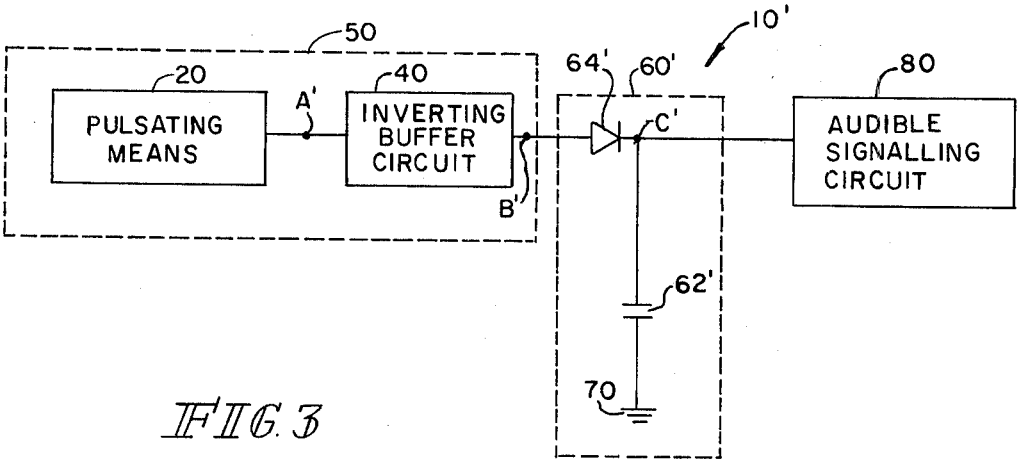
FIG. 3 is a schematic and block illustration of another embodiment of the audible signalling system of the present invention.

Referring now to FIG. 3 there is shown another embodiment of audible signalling system 10' for producing a chime tone audible signal which includes pulsating circuit means 20 and inverting buffer circuit 40 which in combination comprise circuit means 50 for driving audible signalling circuit 80 and another embodiment 60' of circuit means for exponentially decaying a pulsed electrical signal provided by circuit means 50 whereby an audio output is produced by audible signalling circuit 80 which is similar to a chime tone. Junctions A' and B' are representative of the outputs of pulsating means 20 and inverting buffer circuit 40 respectively. As illustrated, circuit means 60' includes a capacitor 62' electrically coupled through a diode 64' to circuit means 50 in parallel with audible signalling circuit 80. In this embodiment capacitor 62' is rapidly charged through inverting buffer circuit 40 when the output (junction B') of circuit 40 is high (10% of period t).

Figure 4:
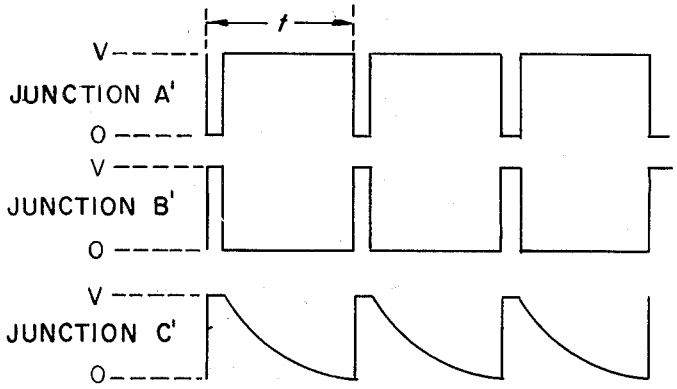
FIG. 4 is a representation of voltage waveforms taken from several locations in the audible signalling system illustrated in FIG. 3.

The sound level of the audible signal provided by audible signalling circuit 80 is related to the magnitude of the voltage at at junction C' (See FIG. 4) and is a maximum when the voltage at junction B' is high. When the output (junction B') of inverting buffer circuit 40 goes low (90% of period t) the voltage across capacitor 62' immediately begins to exponentially decay to the end of the period t. Simultaneously, the sound level of the audible signal provided by audible signalling circuit 80 correspondingly decreases exponentially thereby producing a sound output similar in nature to a chime tone. Diode 64' prevents capacitor 62' from discharging through inverting buffer circuit 40 when the output of buffer circuit 40 (junction B') is low. Importantly, component values for resistors capacitors of pulsating circuit means 20 and capacitor 62' of circuit means 60' would again be chosen to give a repetition rate of pulses and a decay time whereby a new peak audible signal occurs at substantially the same moment that the exponential decay of the previous audible signal is completed. FIG. 4 shows the pulsed electrical signals appearing at junctions A' and B' and the pulsed exponentially decaying signal appearing at junction C' which is also representative of the pulsed exponentially decaying audible signal produced by audible signalling circuit 80 in response thereto.

In view of the above description of the preferred embodiment of our invention it will be seen that the several objects of our invention are achieved and other advantageous results attained and that further modifications can be made without departing from the spirit and scope of our invention as defined in the appended claims.

What is claimed is:

1. An audio system producing a chime tone audible signal comprising an audible signalling circuit including a piezoelectric transducer, circuit means for driving said audible signalling circuit and for causing a pulsed audible signal to be produced by said piezoelectric transducer, and means electrically interposed between said circuit means and said audible signalling circuit for exponentially decaying said pulsed audible signal to thereby produce a chime tone audible signal.

2. The audio system as recited in claim 1 wherein said means for exponentially decaying said pulsed audible signal includes a capacitive element which is charged in response to said circuit means thereby causing said audible signalling circuit to provide a peak audible signal and thereafter causing said peak audible signal to decay exponentially.

3. The audio system as recited in claim 2 wherein said capacitive element is electrically coupled in series with said circuit means and said audible signalling circuit and is charged through said audible signalling circuit in response to a high output of said circuit means.

4. The audio system as recited in claim 3 wherein said means for exponentially decaying said pulsed audible signals further includes a reverse biased diode electrically coupled to said capacitive element in parallel with said audible signalling circuit whereby said capacitive element discharges through said diode in response to a low output of said circuit means.

5. The audio system as recited in claim 2 wherein said capacitive element is electrically coupled to said circuit means in parallel with said audible signalling circuit and is charged through said circuit means in response to a high output of said circuit means and is discharged through said audible signalling circuit in response to a low output of said circuit means.

6. The audio system as recited in claim 2 wherein said circuit means includes a means for pulsating an electrical signal and an inverting buffer circuit electrically interposed between said pulsating means and said capacitive element for isolating said capacitive element and inverting the output of said pulsating means.

7. The audio system as recited in claim 6 wherein said pulsating means provides a pulsed electrical signal having a period within which the output of said pulsating means is high for a substantially small portion of said period and is low for a substantially large portion of said period.

8. The audio system as recited in claim 7 wherein the output of said pulsating means is high for at most 10% of said period and is low for at least 90% of said period of said pulsed electrical signal.

9. The audio system as recited in claim 7 wherein the output of said inverting buffer circuit is high for said substantially large portion of said period of said pulsed electrical signal during which said capacitive element is charged and said peak audible signal is provided and exponentially decayed thereby producing said chime tone audible signal.

10. The audio system as recited in claim 9 wherein the output of said inverting buffer circuit is low for said substantially small portion of said period of said pulsed electrical signal during which said capacitive element is discharged and said exponentially decaying audible signal is concluded whereby the time between the conclusion of said exponentially decaying audible signal and a subsequent peak audible signal is very small.

11. The audio system as recited in claim 6 wherein said pulsating means provides a pulsed electrical signal having a period within which the output of said pulsating means is low for a substantially small portion of said period and is high for a substantially large portion of said period.

12. The audio system as recited in claim 11 wherein the output of said pulsating means is low for at most 10% of said period and is high for at least 90% of said period of said pulsed electrical signal.

13. The audio system as recited in claim 11 wherein the output of said inverting buffer circuit is high for said substantially small portion of said period of said pulsed electrical signal during which said capacitive element is charged and said peak audible signal is provided.

14. The audio system as recited in claim 13 wherein the output of said inverting buffer circuit is low for said substantially large portion of said period of said pulsed electrical signal during which said capacitive element is discharged and said peak audible signal exponentially decays thereby producing said chime tone audible signal.

15. In an audible signalling system which utilized a piezoelectric component to provide an audible signal and includes circuitry for sufficiently driving said piezoelectric component to produce said audible signal, the improvement comprising: circuit means electrically coupled to said circuitry for driving said piezoelectric component for producing a chime tone audible signal, said circuit means including pulsating means for providing a pulsed audible signal and means for exponentially decaying said pulsed audible signal to produce said chime tone audible signal.

* * * * *

US004213121C1

(12) REEXAMINATION CERTIFICATE (4573rd)

United States Patent

Lears et al.

(10) Number: US 4,213,121 C1

(45) Certificate Issued: May 14, 2002

(54) CHIME TONE AUDIO SYSTEM UTILIZING A PIEZOELECTRIC TRANSDUCER

(75) Inventors: Richard L. Lears, Indianapolis; Louis P. Sweany, Carmel, both of IN (US)

(73) Assignee: Emhardt Industries, Indianapolis, IN (US)

Reexamination Request:
No. 90/003,902, Jul. 14, 1995

Reexamination Certificate for:

| | |
|---|---|
| Patent No.: | **4,213,121** |
| Issued: | **Jul. 15, 1980** |
| Appl. No.: | **05/913,732** |
| Filed: | **Jun. 8, 1978** |

(51) Int. Cl.[7] ..... G08B 3/10

(52) U.S. Cl. ..... 340/384.6; 340/384.3; 340/384.73; 340/384.71; 340/384.1; 84/730; 84/DIG. 24; 968/970; 968/DIG. 1; 984/376; 984/DIG. 1

(58) Field of Search ..... 340/384.1, 384.6, 340/384.7, 384.71, 384.73, 392.1, 392.4, 384.3; 34/730, 702, DIG. 24; 968/970, DIG. 1; 984/376, DIG. 1

(56) References Cited

U.S. PATENT DOCUMENTS

| | | | | |
|---|---|---|---|---|
| 2,574,577 | A | 11/1951 | Martin et al. | 84/695 |
| 3,141,919 | A | 7/1964 | Mabuchhi | 84/702 |
| 3,484,531 | A | 12/1969 | Schmidt | 84/702 |
| 3,636,801 | A | 1/1972 | Ichikawa | 84/702 |
| 3,681,916 | A | 8/1972 | Itoyama et al. | 340/384.71 |
| 3,742,112 | A | 6/1973 | Okamoto | 84/702 |
| 3,815,129 | A | 6/1974 | Sweany | 340/384.6 |
| 3,912,952 | A | 10/1975 | Kumon et al. | 340/384.6 |
| 4,001,816 | A | 1/1977 | Yamada et al. | 340/384.5 |

FOREIGN PATENT DOCUMENTS

JP 51-141591 12/1976

OTHER PUBLICATIONS

William Benton et al. (Pub.), *The New Encyclopædia Britannica*, Encylopædia Britannica, Inc., Chicago, 1975, vol. 11, 15th ed., pp. 846, 868.

William A. Neilson et al. (eds.), *Webster's New International Dictionary of the English Language*, G. & C. Merriam Co., Springfield, 1934, 2nd ed. p, 1816.

Forrest M. Mims, "Percussion Instrument Synthesizer", *Popular Electronics*, Mar. 1976, p. 100.

Don Lancaster, "Components For Electronic Music Systems: Tone generators, Keyboards, and voicing techniques", *Popular Electronics*, Nov. 1973, pp. 47–50.

Bernard Grob et al., *Applications of Electronics*, (New York: McGraw–Hill Book Company, Inc., 1960) pp. 214–215, 456–457.

Lou Garner, "'Tis The Season To Be Solid", *Popular Electronics*, Dec. 1976, pp. 90–93.

D. V. DiMassimo et al., "Astable and Monostable Oscillators Using RCA COS/MOS Digital Integrated Circuits", *Digital Integrated Circuits Application Note ICAN–6466*, RCA Solid State Division, Somerville, NJ, May 1976, pp. 1–12.

*Primary Examiner*—Donnie L. Crosland

(57) ABSTRACT

An audible signalling system utilizes a piezoelectric transducer to produce a chime tone audible signal. The system includes audible signalling circuitry, circuitry for driving the audible signalling circuitry to provide a pulsed audible signal, and circuitry for exponentially decaying the pulsed audible signal to produce a chime tone audible signal.

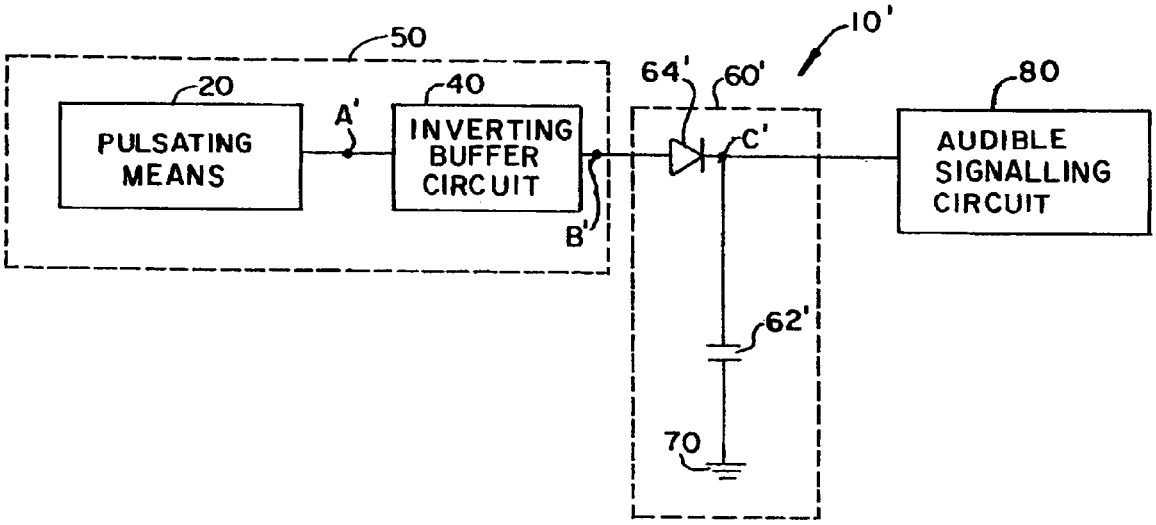

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *